US006185943B1

(12) United States Patent
Kopko

(10) Patent No.: US 6,185,943 B1
(45) Date of Patent: Feb. 13, 2001

(54) HIGH-EFFICIENCY AIR-CONDITIONING SYSTEM WITH HIGH-VOLUME AIR DISTRIBUTION

(75) Inventor: William L. Kopko, Springfield, VA (US)

(73) Assignee: Work Smart Energy Enterprises, Inc., Washington, DC (US)

( * ) Notice: Under 35 U.S.C. 154(b), the term of this patent shall be extended for 0 days.

(21) Appl. No.: 09/331,758

(22) PCT Filed: May 15, 1998

(86) PCT No.: PCT/US98/10037

§ 371 Date: Jun. 25, 1999

§ 102(e) Date: Jun. 25, 1999

(87) PCT Pub. No.: WO98/51978

PCT Pub. Date: Nov. 19, 1998

Related U.S. Application Data

(60) Provisional application No. 60/046,676, filed on May 16, 1997.

(51) Int. Cl.[7] ..... F25D 17/06

(52) U.S. Cl. ..... 62/89; 62/93; 62/259.1; 62/426

(58) Field of Search ..... 62/259.1, 426, 62/93, 89

(56) References Cited

U.S. PATENT DOCUMENTS

| | | | | |
|---|---|---|---|---|
| 2,793,508 | * | 5/1957 | Mueller | 62/259.1 |
| 4,244,193 | * | 1/1981 | Haakenson | 62/180 |
| 4,258,615 | * | 3/1981 | Vivian | 98/40 |
| 4,497,182 | * | 2/1985 | Youngworth | 62/151 |
| 4,683,942 | * | 8/1987 | Bierkamp et al. | 165/53 |
| 4,719,761 | * | 1/1988 | Cromer | 62/94 |
| 4,769,053 | * | 9/1988 | Fischer, Jr. | 55/389 |
| 5,065,585 | * | 11/1991 | Wylie et al. | 62/89 |
| 5,179,998 | * | 1/1993 | Des Champs | 165/1 |
| 5,265,442 | * | 11/1993 | Lamie | 62/404 |
| 5,313,803 | * | 5/1994 | Detzer | 62/89 |
| 5,495,724 | * | 3/1996 | Koster | 62/259.1 |
| 5,775,125 | * | 7/1998 | Sakai et al. | 62/410 |
| 5,890,372 | * | 4/1999 | Belding et al. | 62/271 |
| 5,911,747 | * | 6/1999 | Gauthier | 62/176.6 |
| 5,996,354 | * | 12/1999 | Sokolean et al. | 62/80 |
| 6,021,644 | * | 2/2000 | Ares et al. | 62/151 |

* cited by examiner

*Primary Examiner*—William Doerrler
*Assistant Examiner*—Mark Shulman
(74) *Attorney, Agent, or Firm*—Rothwell, Figg, Ernst & Manbeck

(57) ABSTRACT

A system and method for providing conditioned air to the interior space of a building includes separate dehumidification and sensible cooling functions. The separate dehumidification allows for much higher supply air temperatures, preferably within about 10° F. to about 15° F. of the air temperature of the building space. Low-velocity air distribution through a ceiling plenum or a vent into the space allows for very low fan static pressures, which greatly reduces fan energy usage compared to conventional ducted systems. The low static pressures and high supply-air temperatures allow the use of existing drop ceiling construction with little modification. Optional return air channels between an inner glazing and an outer glazing of exterior windows can virtually eliminate heating loads at the building perimeter, which virtually eliminates the need for simultaneous heating and cooling. The result is a major improvement in energy efficiency and comfort while reducing installed cost of the system.

23 Claims, 3 Drawing Sheets

HIGH-EFFICIENCY AIR-CONDITIONING SYSTEM WITH HIGH-VOLUME AIR DISTRIBUTION

Applicant claims the benefit of U.S. provisional application serial number 60/046,676 filed on May 16, 1997.

BACKGROUND OF THE INVENTION

1. Field of the Invention

The present invention generally relates to ventilation systems for buildings, and more particularly relates to methods and systems for providing good quality conditioned air to occupied building spaces.

2. Background and Prior Art

Air-conditioning manufacturers, architects, and professional design engineers have expended huge efforts in optimizing the design of building air-conditioning and ventilation systems. Annual sales of equipment amount to tens of billions of dollars and annual energy costs for heating and cooling have similar magnitudes. In addition, the costs associated with reduced productivity of workers because of uncomfortable environmental conditions may be several times these figures, although such consequential costs are difficult to quantify. Yet despite these efforts at optimization the fundamental principles for ventilating and conditioning the air in buildings have remained essentially the same since the introduction of the first air conditioners in the 1920s. Conventional approaches to air conditioning have inherent problems that severely limit their efficiency, raise installed cost, and frequently produce poor environmental comfort conditions in the building space. Solving these problems requires major changes in the basic configuration of air-conditioning systems.

Conventional air-conditioning systems use a relatively small volume of air for cooling. The typical arrangement uses a vapor-compression refrigeration system to cool a mixture of return air and outside air to approximately 55° F. and then distribute the cooled air through ducts to the building space. The low supply air temperatures are used because of the need to cool the air below its dew point to remove moisture. The low air temperatures are also necessary to meet the sensible cooling needs of the space without using excessively large ducts.

There are several significant problems with this approach. The first relates to fan or blower energy consumption. Because air in the conventional systems flows through relatively restrictive ductwork, fan static pressures are quite high. Typical pressures range from less than 0.5 inches of water for residential systems to as much as 5 to 10 inches of water for large commercial cooling systems. These high static pressures result in large energy consumption by the fan, and also add to the cooling load for the rest of the system. In many commercial systems, the heat generated by fan operation accounts for as much as 20 to 30 percent of the total cooling load for the building. The net result is a very inefficient cooling system.

A second problem pertains to the high compressor energy required. The required low air supply temperatures dictate even lower evaporating temperatures, typically 40° to 50° F. for the compressor system. Such low evaporating temperatures necessitate increased work for the compressor which further reduces the efficiency of the system.

A third problem with the conventional air conditioning system is poor indoor air quality associated with high duct humidity. Conditions over 70% relative humidity allow the growth of mold and fungus in ductwork. The relative humidity in the supply ducts for conventional systems is frequently over 90%. In addition, water from wet coils drips onto drain pans and can also wet nearby ductwork. These wet conditions create potential breeding grounds for many types of microbes that can cause health, respiratory, and odor problems.

A fourth shortcoming with conventional systems is the high noise levels emitted. The high static pressure caused by restrictive ductwork creates a need for a powerful fan that usually is quite noisy. In addition, metal ducts are notorious noise transmitters. Common fixes for the noise problem include the use of fiberglass duct liners. Unfortunately these liners increase cost and pressure drop and also can contribute to problems with molds given the high relative humidity in most ducts.

A fifth problem is the potential for drafts with conventional cooling systems. The low air supply temperatures and high velocities create the possibility of extremely uncomfortable conditions near the vents. Designers must take special care to ensure adequate mixing of room air and supply air to reduce drafts to acceptable levels.

A sixth problem is the need for simultaneous heating and cooling. Most office buildings have a single air handling system for the interior and exterior zones. In cold weather the interior zones still need cooling because of heat from people, lights, equipment, etc., while the exterior zones need heat. The usual solution is to supply cool air to the entire building in order to satisfy the cooling needs of the interior, while perimeter heaters or local heaters in the ducts servicing the exterior zones provide the heat necessary to satisfy the heating load and overcome the cooling from the supply air.

A major objective of the present invention is thus to improve energy efficiency and to reduce or eliminate the problems associated with existing conventional air conditioning systems discussed above.

SUMMARY OF THE INVENTION

The present invention uses a fundamentally new and different approach to air conditioning. The invention involves the use of a large volumetric flow rate of air with a temperature that is close to that of the building space for space heating and cooling. A separate dehumidification system is used in humid climates. In one preferred embodiment, a ceiling plenum is used for the supply air and air returns throughout the building space. In another preferred embodiment, supply air enters the space through a vent near the ceiling along one wall and returns near the floor along the same wall. Pressure drops are kept very low because of the low air velocities. The low pressure and small temperature difference between the supply air and the room air allow for very low energy use and improved comfort.

BRIEF DESCRIPTION OF THE DRAWINGS

The novel features of the present invention will become more clearly understood from the following detailed description in conjunction with the accompanying drawings, in which.

DETAILED DESCRIPTION OF THE PREFERRED EMBODIMENTS

Figure 1:
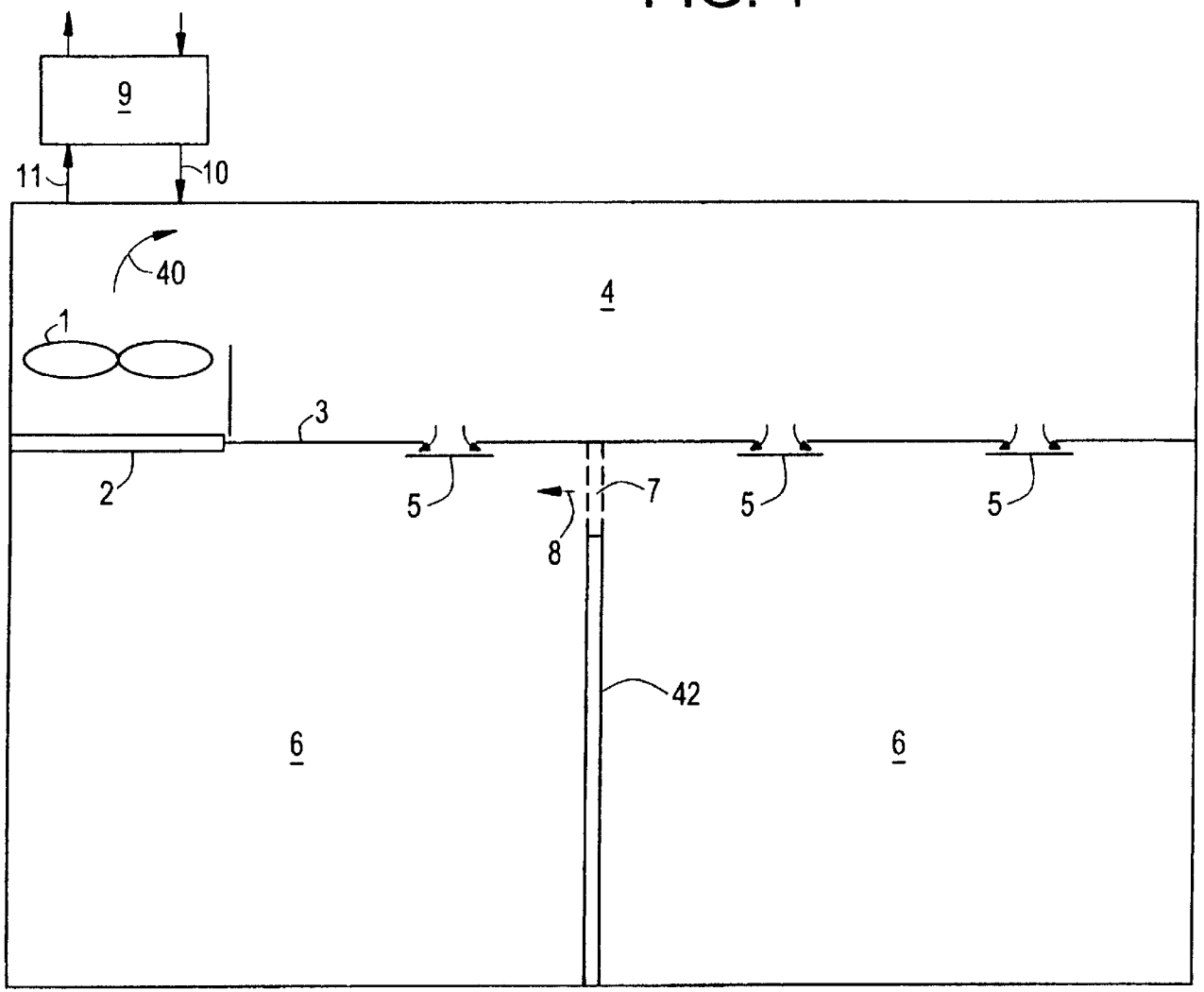
FIG. 1 is a schematic block diagram of an air conditioning system according to a first preferred embodiment of the present invention.

FIG. 1 shows a first preferred embodiment of an air conditioning system according to the invention. Fan 1 draws intake air across coil 2, where it is cooled or heated. Ceiling 3 defines the bottom of a ceiling plenum 4 that serves as a flow path for air 40 leaving the fan 1. In contrast to conventional restrictive metal ducts, plenum 4 may extend over the entire area of interior building space 6. Coil 2 is located in or above ceiling 3, such that air from interior building space 6 is drawn across coil 2 and into plenum 4 by the fan 1. A number of vents 5 in ceiling 3 provide openings into the building space 6. Vent 7 in interior wall 42 provides an opening to allow air 8 to return to the coil through the building space. A separate external ventilation system 9 provides dehumidified outside air 10 to the building space through the plenum 4, and recovers energy from exhaust air 11.

The fan 1 may be a propeller type, centrifugal fan, or other equivalent fan appropriate for moving large volumes of air. The fan 1 provides only a small static pressure, typically less than 0.2 inches of water. The low static pressures favor the use of low-speed fans, which result in a reduction of fan sound levels and fan energy usage in comparison with existing conventional systems.

The coil 2 can contain water, brine or a liquid refrigerant made of substances well known in the art. The temperature of the cool supply air for cooling the space 6 through vents 5 normally would be greater than 65° F., and preferably about 70° F. Such higher temperatures prevent unwanted heat transfer through the ceiling 3 and help to keep the relative humidity in the plenum 4 below 70%. The coil temperature should be a least a few degrees above the dewpoint of the return air and preferably as close as practical to that of the supply air temperature. The high coil temperatures minimize the compressor energy required for cooling and eliminate problems associated with wet coils.

The ceiling 3 normally would be a suspended ceiling, as generally known. The ceiling tiles should be sufficiently rigid to withstand the air pressure within the plenum 4, which would normally be less than 0.1 inches of water. The low static pressures in the plenum reduce the load on the tiles and reduce problems associated with air leakage around the edges of the tiles. The tiles should provide sufficient resistance to leakage and heat conduction to prevent undesirable heat transfer between the plenum 4 and the space 6. In many cases, existing suspended ceilings would meet these requirements without any significant modification.

Vents 5 are designed to handle a large volume of air with a minimal pressure drop, typically only a few hundredths of an inch of water. Adjustment of the vents 5 may be manual or automatic. The vents are configured to introduce sufficient mixing so as to prevent undesirable drafts.

Vents 7, which allow air to move between zones, must be able to handle the required air flow with pressure drops that are smaller than the pressure drop across the ceiling vents. Alternatively, in buildings with raised floors, air may be returned to the coil through the space under the floor. Vents 7 also may be provided with a control mechanism that is responsive to interior space temperature without the need for a separate power source. For example, wax actuators and shape-memory actuators are capable of producing significant amounts of motion in response to relatively small changes in space temperature and could be used to control air flow through the vents. Co-pending U.S. provisional application serial number 60/077008 describes a roller damper mechanism that can work with these types of actuators.

While in the embodiment of FIG. 1 the dehumidified outside ventilation air 10 enters the building space through the ceiling plenum, the exact location where the ventilation air is sent into the building space is somewhat arbitrary, so long as the temperature of the ventilation air is close to the temperature of the ambient air in the building space. Likewise, the exhaust air 11 may be drawn from any location in the building and normally at least a portion would come from toilet exhaust. The ventilation/dehumidification system should incorporate an enthalpy wheel or other heat recovery device as generally known in the art, and preferably would be a desiccant-based system capable of providing low dewpoints. The temperature of the ventilation air should be close to the temperature of the air in the building space, although this would not be required if the ventilation air is mixed into the supply air. The ventilation system should also provide a small positive pressure for the building space to reduce possible of infiltration of outside air.

While the preferred dehumidification system is combined with a heat recovery ventilation system, many other configurations are possible. For example, the dehumidification system can simply further cool a portion of the air 40 leaving the cooling coil 2 so that temperature of the air 40 drops below the dewpoint. A heat pipe or other device for exchanging heat between the air on the coil and the air leaving the coil can increase the amount of moisture removed compared to sensible cooling, which further reduces energy usage. Such an arrangement is acceptable in cases where adequate outside air is available to the building space from infiltration or other sources. Numerous other dehumidification systems generally known in the prior art also could be used in the system of the present invention. The ASHRAE Handbooks describe many of these dehumidification options.

In dry climates the dehumidification system can be eliminated, although sensible heat recovery still may be a valuable option. There also exists the possibility of eliminating the need for a compressor, with sensible cooling provided with an indirect evaporative cooler or cooling tower.

The table below shows the massive energy advantages of the invention when compared to a conventional air-conditioning system in handling the sensible cooling load:

Comparison of Energy Use for a Conventional Cooling System and New Invention

| | conventional | new high-flow | units |
|---|---|---|---|
| zone sensible load | 20 | 20 | btu/hr/ft2 |
| supply air temperature | 55 | 70 | deg F. |
| room temperature | 75 | 77 | deg F. |
| cfm/ton of total sensible load | 556 | 1587 | cfm/ton |
| fan static pressure | 6 | 0.2 | inches H2O |
| fan static efficiency | 70% | 50% | |
| motor efficiency | 90% | 80% | |
| fan power (hp/1000 CFM) | 1.349 | 0.063 | hp/1000 cfm |
| fan power (w/CFM) | 1.12 | 0.06 | w/cfm |
| fan healing | 3.53 | 0.19 | deg F. |
| fan heat (% of sensible load) | 18% | 3% | |
| coil load | 23.5 | 20.5 | btu/hr/ft2 |

-continued

Comparison of Energy Use for a Conventional Cooling System and New Invention

| | conventional | new high-flow | units |
|---|---|---|---|
| chilled water temperature | 45 | 66 | deg F. |
| chiller energy use | 0.6 | 0.3 | kw/coil ton |
| chiller energy use | 0.076 | 0.308 | kw/building ton |
| fan energy use | 0.528 | 0.091 | kw/building ton |
| total energy use | 1.234 | 0.399 | kw/building ton |
| percent energy saved | | 67.7% | |

This analysis shows that the new system can save over two thirds of the energy used for sensible cooling at design conditions as compared with the systems of the prior art. At off-design conditions energy savings can be even larger because of the increased availability of free cooling, as a result of the much higher chilled water and supply air temperatures. The free cooling option allows the chiller to be shut down for a large portion of what is normally the cooling season.

The system of the present invention also has a major advantage in handling latent load. The use of an enthalpy wheel or other suitable heat exchanger can reduce loads associated with bringing in outside air by 80%. Heat recovery also greatly reduces heating requirements. For most office and retail buildings, the outside air is the main source of moisture. Use of a gas-driven desiccant system provides the opportunity to greatly reduce electricity demand charges while efficiently handling the ventilation load. Electrically driven systems are also an option.

Use of a separate dehumidification system also greatly reduces the need to run the whole system when a commercial building is unoccupied. Current systems frequently require continuous operation during conditions of high humidity in order to prevent excessive accumulation of moisture in building materials during periods of low occupancy, such as overnight or on weekends. The present invention allows the operation of the dehumidification system alone, which greatly reduces operating costs while providing good moisture control.

Figure 2:
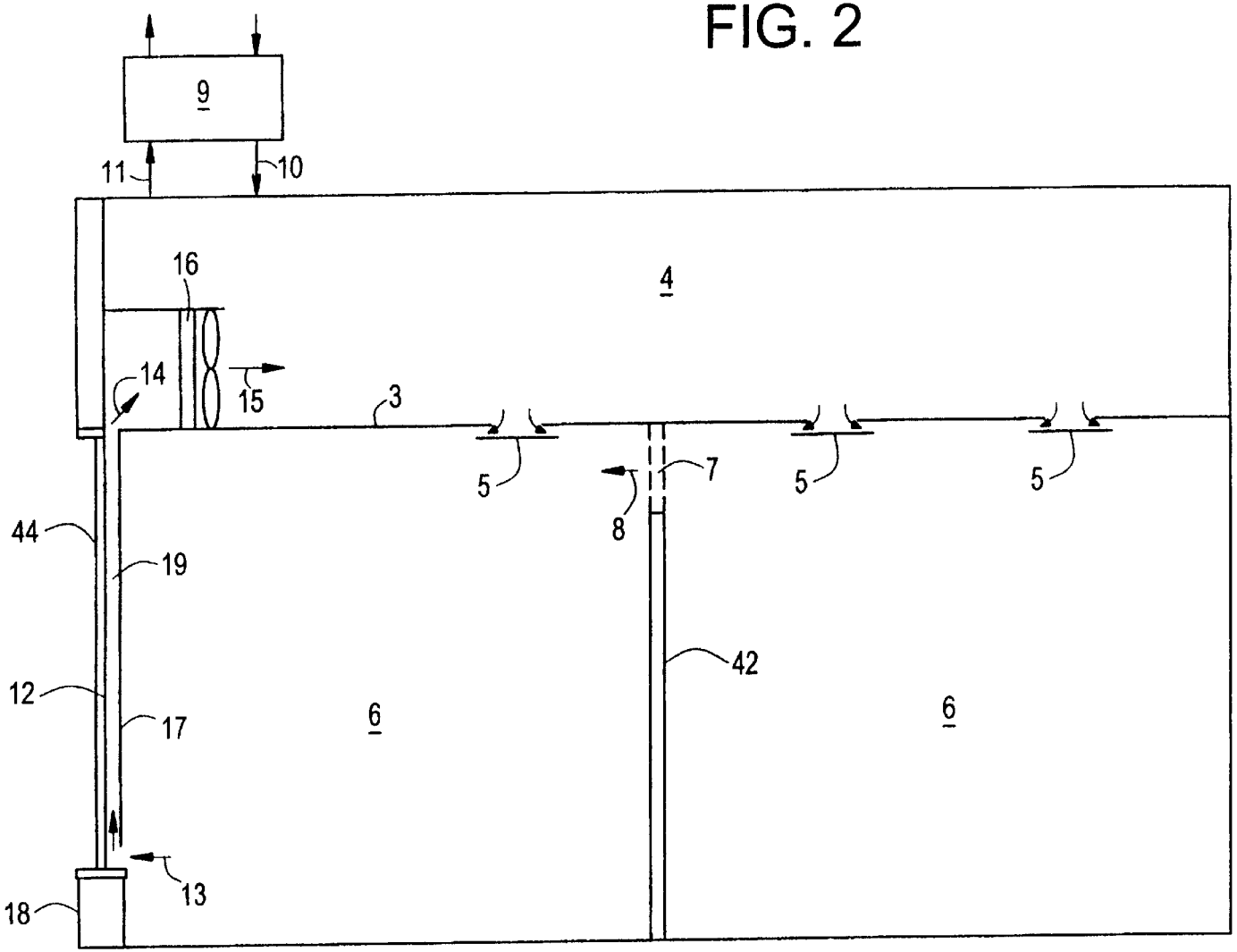
FIG. 2 is a schematic block diagram of a variation of the air conditioning system of FIG. 1 as a second embodiment.

FIG. 2 shows a variation of the first embodiment. The system of FIG. 2 is designed to greatly reduce the need for heating. According to this embodiment, a large volume of air is moved from the interior toward the exterior of the building, and return air is drawn from the building envelope. Specifically, return air 13 is drawn from space 6 upward through channel 19 formed between the exterior glazing 12 and the interior glazing 17 of a window 44. This arrangement effectively eliminates any cold air resulting from heat loss through exterior glazing 12 and exterior wall 18. The return air then moves into channel 14, and through coil 16 as drawn by fan 15, and the conditioned air is discharged into the ceiling plenum 4 where it is distributed into the building space 6 through vents 5.

This configuration achieves several advantages that greatly reduce winter heating requirements. The first advantage is that cold air is removed from the building envelope before it enters the conditioned space, by channeling return air adjacent to the exterior of the building. The second advantage is that this air is then routed toward the interior space to provide necessary cooling. Thirdly, the air returning from interior zones is used as a source of warm air for the exterior zones. This system does not require any significant amount of heat so long as the interior heat generation exceeds the exterior heating load. Proper insulation of windows and walls can effectively eliminate the need for heat in most larger buildings even in the most severe climates. The only time that heat would be required would be if the building were unoccupied for a long period of time with limited sunlight. Under these circumstances, the coils would provide heat to warm the entire building.

Figure 3:
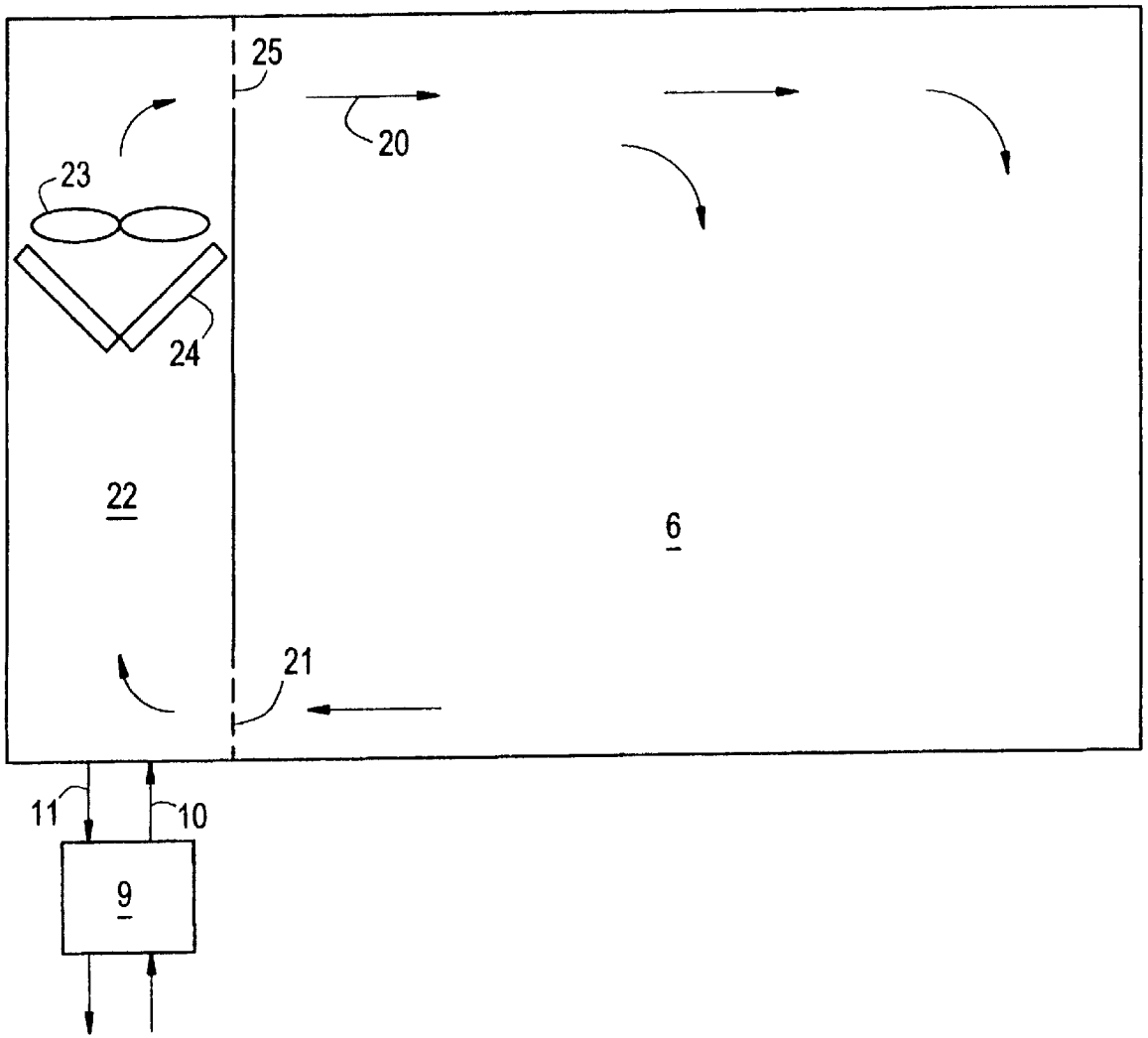
FIG. 3 is a schematic block diagram of a third preferred embodiment of an air conditioning system according to the present invention.

FIG. 3 shows a third preferred embodiment of the invention. This configuration is suitable in retail space or similar locations with large open areas and few obstructions near the ceiling. In this embodiment, fan 23 moves supply air 20 from coil 24 through vent 25 and into building space 6. The air returns through register 21 and return duct 22, back to coil 24. As with the other embodiments, a separate dehumidification system 9 supplies outside air and recovers heat from exhaust air.

The large volumetric flow rates and relatively warm temperatures of the supply air allow for very long "throws" that may be necessary to supply air to a large space. The higher supply temperatures also greatly reduce the risk of uncomfortable drafts in the space. As with the other embodiments, this system has a large advantage in efficiency because of the high coil temperatures and low fan static pressures. It also has a major first cost advantage since it virtually eliminates the need for ductwork. One disadvantage is that it does not provide local temperature control within the building space, which may limit its application.

In conclusion, the present invention provides the following benefits and advantages over the prior art:

reduced fan energy, less compressor energy, less ductwork required, smaller space requirements, reduced heating requirements, individual room control possible, drier coils (reduced maintenance), better indoor air quality, lower noise, no cold drafts, and the opportunity for increased use of economizer operation.

The invention having been thus described, it will become apparent to those skilled in the art that the same may be varied in many ways without departing from the spirit and scope of the invention. Any and all such modifications are intended to be covered within the scope of the following claims.

What is claimed is:

1. A method for providing conditioned air to an interior space within a building, comprising the steps of:

obtaining a stream of air from said space;

cooling said stream of air to a temperature that is within about 15° F. of the temperature of the air in said space, without removing moisture from said stream of air;

supplying the resulting cooled air to said space; and supplying a separate source of dehumidified air to said space.

2. The method of claim 1, wherein the temperature of said cooled stream of air is within about 10° F. of the building space air temperature.

3. The method of claim 1, wherein the relative humidity of the air stream after cooling is not more than about 90%.

4. The method of claim 1, wherein the relative humidity of the air stream after cooling is not more than about 70%.

5. The method of claim 1, wherein the step of supplying cooled air comprises the steps of:

blowing said stream of air into a ceiling plenum located between a ceiling of said building and a suspended ceiling below said building ceiling; and distributing the cooled air to said space through a plurality of vents in said suspended ceiling.

6. The method of claim 1, wherein the step of supplying cooled air comprises:

blowing the cooled air in a substantially horizontal direction at a low velocity into a separate space above said interior space.

7. The method of claim 1, wherein the step of obtaining a stream of air from the space comprises the step of drawing the stream of air from the room through an elongated flow channel provided adjacent to an exterior surface of said building.

8. The method of claim 1, wherein the step of supplying dehumidified air to the space further comprises the steps of:

a) retrieving a separate portion of said cooled air stream;

b) further cooling the separate portion of the cooled air stream below the dewpoint to remove moisture therefrom; and c) returning the dehumidified air to the remainder of said cooled air stream.

9. The method of claim 1, wherein the step of supplying dehumidified air to the space further comprises the steps of:

a) drawing in a stream of outside air external to said building;

b) removing moisture from said outside air stream to obtain a stream of dehumidified air;

c) supplying the dehumidified air to the space; and d) exhausting air from the space corresponding to the volume dehumidified air supplied into the space.

10. The method of claim 9, further comprising the step of exchanging thermal energy and moisture between the exhaust air from the space and the incoming outside air stream.

11. The method of claim 9, wherein the step of removing moisture from said outside air stream comprises the step of cooling said outside air stream to a temperature below the outside dewpoint temperature.

12. The method of claim 9, wherein the step of removing moisture from said outside air stream comprises the step of contacting said outside air stream with a dry desiccant material.

13. The method of claim 7 wherein said flow channel comprises a flow path in a perimeter window between an exterior glazing and an interior glazing of said window.

14. An apparatus for distributing conditioned air to an interior space within a building, comprising:

a suspended ceiling located in said interior space below a second ceiling above the suspended ceiling, said suspended ceiling and said second ceiling comprising a bottom and a top of a plenum, respectively;

a source of conditioned air, coupled to said plenum, that has a temperature that is within the range of about 10° F. to 15° F. of the air temperature of said space, and that is at a pressure above that of the air in said space; and a plurality of vents that control air flow through a flow path between the plenum and said space.

15. An apparatus for conditioning the air in a space within a building, comprising:

a source of conditioned air having a temperature that is within the range of about 10° F. to 15° F. of the air temperature of said space, and having a pressure that is above that of the air in the space;

at least one vent that distributes to said space a low-velocity stream of said conditioned air in a substantially horizontal direction adjacent to a ceiling above said space; and a return flow path between said vent and said source of conditioned air; wherein said source of conditioned air obtains air from said return flow path and cools said air from said return flow path without removing moisture therefrom.

16. The apparatus of claim 15, further comprising means for dehumidifying the air in said space, separate from said source of conditioned air.

17. An air conditioning system for providing conditioned air to the interior space of a building, comprising:

means for drawing a stream of air from said space and for cooling said stream of air to a temperature above the dew point, such that no moisture is removed from said stream of air, to produce a cooled stream of air;

means for distributing said cooled stream of air to said space; and means for drawing a stream of outside air external to said building and for dehumidifying said stream of outside air, and for providing the stream of dehumidified outside air to said space.

18. The air conditioning system of claim 17, wherein said stream of air from said space is cooled to a temperature that is within the range of about 10° F. to about 15° F. of the temperature of the air within said space.

19. The air conditioning system of claim 17, wherein said distributing means comprises a plenum located between a first ceiling of said space and a suspended ceiling below said first ceiling.

20. The air conditioning system of claim 18, further comprising a plurality of vents in said suspending ceiling which introduce said cooled stream of air into said space in a horizontal direction.

21. The system of claim 17, wherein said means for drawing and for dehumidifying further comprises means for drawing a stream of exhaust air from said space.

22. An air conditioning system for providing conditioned air to the interior space of a building, comprising:

means for drawing a stream of air from said space and for cooling said stream of air to a temperature above the dew point, such that no moisture is removed from said stream of air, to produce a cooled stream of air; and means for distributing said cooled stream of air to said space;

wherein said means for drawing includes a low-velocity fan providing a static pressure on the order of 0.2 inches of water.

23. An air conditioning system for providing conditioned air to the interior space of a building, comprising:

at least one flow channel formed between the interior glazing and the exterior glazing of a perimeter window of said building;

means for drawing a stream of air from said space through said flow channel, and for cooling said stream of air to a predetermined temperature, without removing any moisture from said stream of air; and means for distributing said cooled stream of air to said space.

* * * * *